United States Patent [19]

Nelson et al.

[11] Patent Number: 4,629,202

[45] Date of Patent: Dec. 16, 1986

[54] COMBINATION GOLF CART AND BAG

[76] Inventors: Veryl H. Nelson, 712 Rucker Ave., Everett, Wash. 98201; Reid V. Nelson, 500 - 13th St., Snohomish, Wash. 98290

[21] Appl. No.: 728,809

[22] Filed: Apr. 30, 1985

Related U.S. Application Data

[63] Continuation-in-part of Ser. No. 538,756, Dec. 12, 1983, abandoned.

[51] Int. Cl.[4] ..... B62B 1/04

[52] U.S. Cl. ..... 280/47.26; 206/315.2; 280/DIG. 6

[58] Field of Search ..... 280/DIG. 6, 30, 47.26, 280/35, 652; 206/315.2, 315.3; 224/274; 248/96

[56] References Cited

U.S. PATENT DOCUMENTS

| | | | |
|---|---|---|---|
| 2,256,521 | 9/1941 | Kirkpatrick | 206/315.3 |
| 2,508,059 | 5/1950 | Burtt | 280/DIG. 6 |
| 2,590,178 | 3/1952 | Jamison | 280/DIG. 6 |
| 2,628,801 | 2/1953 | Gunning | 280/DIG. 6 |
| 2,868,559 | 1/1954 | Vincelette | 280/DIG. 6 |
| 3,738,677 | 6/1973 | Renock | 280/DIG. 6 |
| 3,787,017 | 1/1974 | Sauer | 248/96 |
| 4,017,091 | 3/1977 | Wallen | 280/DIG. 6 |
| 4,383,563 | 5/1983 | Kirchhoff | 206/315.2 |

FOREIGN PATENT DOCUMENTS

| | | | |
|---|---|---|---|
| 1374242 | 11/1972 | United Kingdom | 280/47.26 |

*Primary Examiner*—John J. Love
*Assistant Examiner*—Mark C. Dukes
*Attorney, Agent, or Firm*—Roy E. Mattern, Jr.

[57] ABSTRACT

A wheeled golf cart which can be manually pulled over a golf course for transporting golf equipment or carried to and from a golf course to storage or transporting in a vehicle. The entire hand-carried cart can be converted into a full manually mobile golf cart in seconds for operation on golf course.

3 Claims, 7 Drawing Figures

COMBINATION GOLF CART AND BAG

CROSS REFERENCE

This application is a continuation-in-part of application Ser. No. 538,756, filed 12/12/83 now abandoned.

BACKGROUND OF THE INVENTION

The invention relates to a cart that is used for golfing equipment either in an operative cart manner or as a storage and transport bag.

There is a variety of prior art describing golf bags that convert to carts. These are disclosed in U.S. Pat. Nos. 2,590,178, issued to L. D. Jamison on Mar. 25, 1952; 3,738,677 issued to James Renock on June 12, 1973; 1,374,242, issued to a Great Britain Group on Nov. 20, 1974; 2,508,059, issued to K. E. Burtt on May 16, 1950; 2,868,559, issued to A. L. Vincelette on Jan. 13, 1959 and 4,017,091, issued to Russell J. Wallen on Apr. 12, 1977. The present invention is an improvement in many ways on the prior art.

Prior golf carts have been complicated mechanically, bulky, heavy, and in one way or another cumbersome to convert and/or operate. This new invention provides a lightweight, durable cart which is mechanically and operatively superior due to simplicity; it holds all the complimentary clubs (14), has separate compartments for balls, tees and clothing and can be transported on and off the course easier than any prior art. The invention is therefore not only novel but superior to its prior art in ways pertaining to mechanics, compactness, and ease of use. And because of its compactness it is very lightweight.

SUMMARY OF THE INVENTION

The combination golf cart and bag invention consist of a lightweight and durable structure that is rectangular in shape and is as compact as possible to provide a carrying unit for a full compliment of golf clubs (14), compartment for balls and tees, and a compartment for appropriate golf clothing and accessories. The cart itself is provided with wheels and wheel struts that 3 easily fit into place without complicated mechanical devises, and a handle which similarly fits into place and when all is not used are stored in similar fashion as the clubs. A support strut which is required on other prior art to stand free is not necessary with this cart.

DETAILED DESCRIPTION OF THE DRAWINGS

Figure 1:
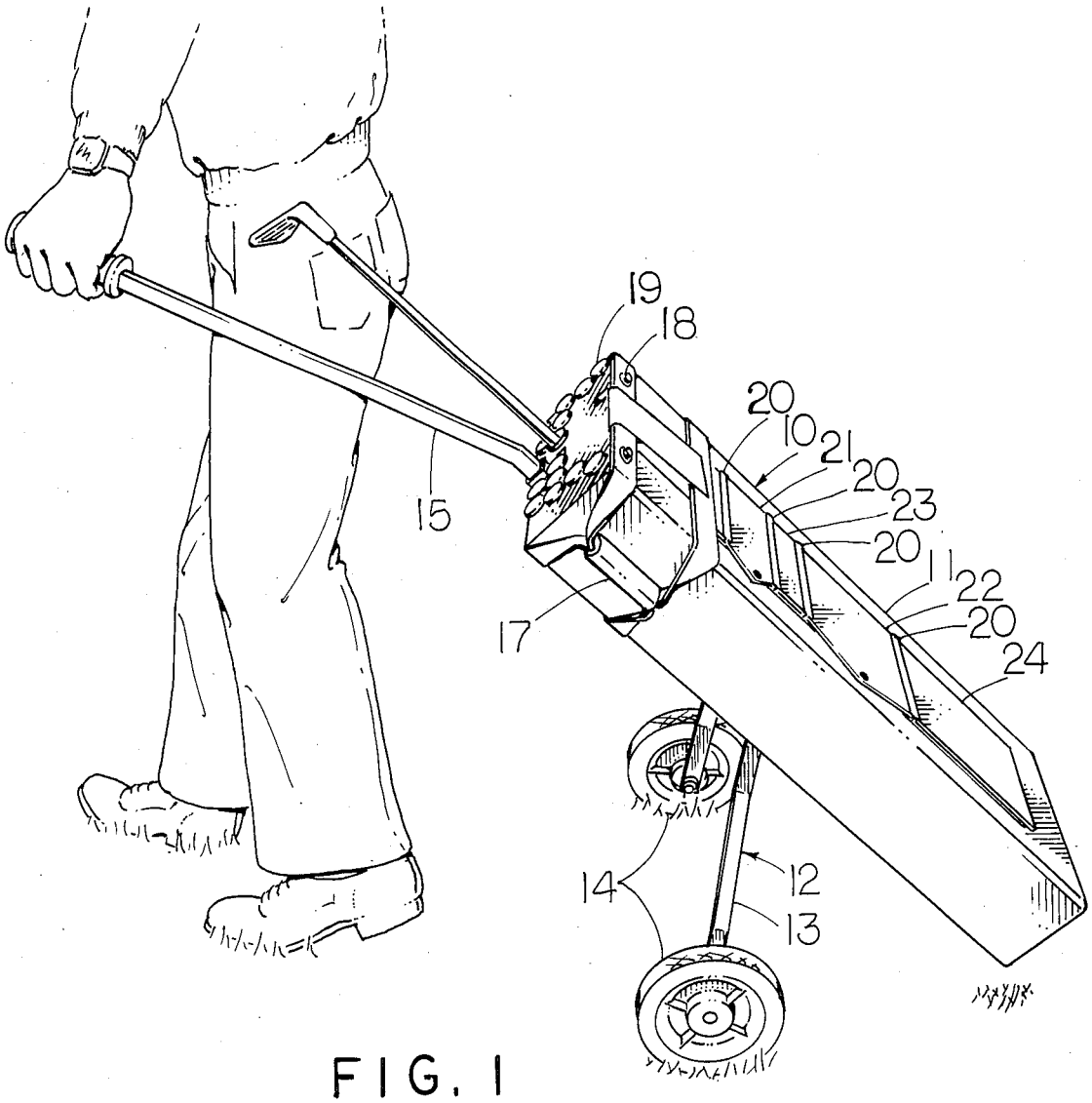
FIG. 1 is a view of the invention in the operative state.

Referring to FIG. 1, there is shown an operative view of the invention. Golf cart 10 is provided with a lightweight sturdy body 11, which can be made of plastic or other suitable material. Plastic offers itself for easy fabricating and assembly. Golf cart body 11 includes two wheel-strut assemblies 12 with individual struts 13 and wheels 14. Wheel-struts 13 are made of aluminum. An operating handle 15 is shown in the operative mode with attachment described in another figure. It is also made of aluminum. The cart body 11 is provided with a carrying handle 17 which is made of a durable material similar to handles on modern luggage and is attached by means of rivets and by attachment snaps 18 for use in attaching top cover. Golf club inserts 19 are inserted into properly oriented holes in top of cart body 11 so that all standard golf clubs can be carried. Golf club inserts are commonly purchased at golf and accessory stores. Plastic grooved slides 20 are used to allow doors 21 and 22 to operate by sliding back and forth. The ball and tee door 21 and clothing door 22 are equiped with stops so doors do not slide entirely off cart 11 when moved to either side. They are also equiped with shims so that when closed they will stay shut. Front panels 23 and 24 are affixed to cart to make up front surfaces of the compartments. Doors 21 and 22 and panels 23 and 24 are elevated slightly so that rain will not enter compartments when in use.

Figure 2:
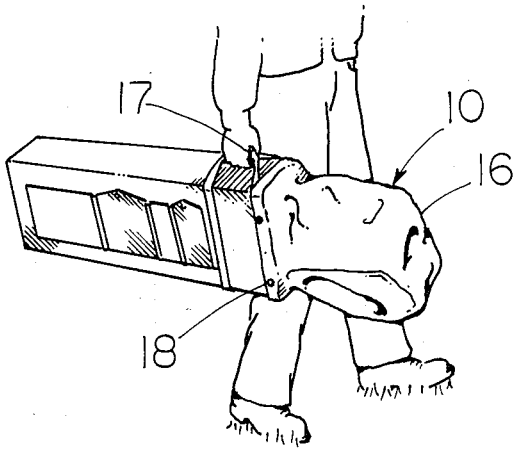
FIG. 2 is a view of the invention while it is being carried to or from the golf course.

Referring now to FIG. 2, there is shown the invention in the hand carried transported position. The golf cart 10 is provided with a top cover 16 which is made of a water repellant material that is durable for protection of clubs, etc. when stored or transported in a vehicle. The top cover 16 is attached to cart 10 via snaps 18. Carrying handle 17 is attached to cart 10 so that when full compliment of clubs and accessories are being transported a balance is easily achieved.

Figure 3:
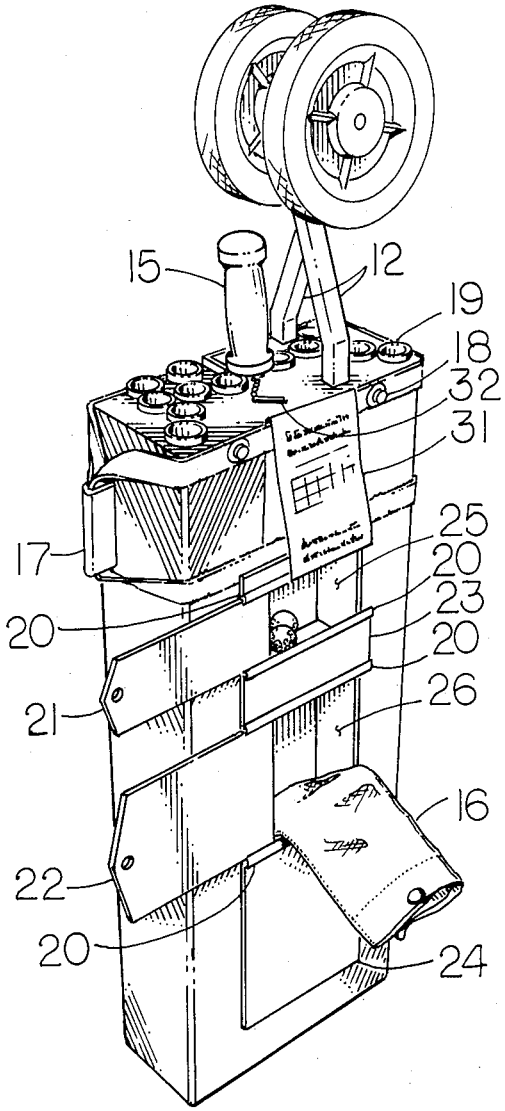
FIG. 3 is a view of the invention showing the compartments and stored wheels and operating handle and top cover.

Referring now to FIG. 3, there is shown a view of the invention with compartments 25 and 26 opened and wheel-strut assemblies 12 and operating handle 15 stored for transporting. The view shows the aforementioned parts; top cover 16 partially in clothing and accessory compartment 26, handle for carrying 17, snaps 18 for top cover attachment, club inserts 19, plastic sides 20, ball and tee door 21, clothing door 22, front panel of ball and tee compartment 23, front panel of clothing and accessory compartment 24. Compartments 25 and 26 are fabricated from same or similar material as the cart body and are constructed so when strategically attached to cart body they re-inforce the entire structure. Golf course score card 31 can easily be carried by slipping a portion of card under handle material 17.

Figure 4:
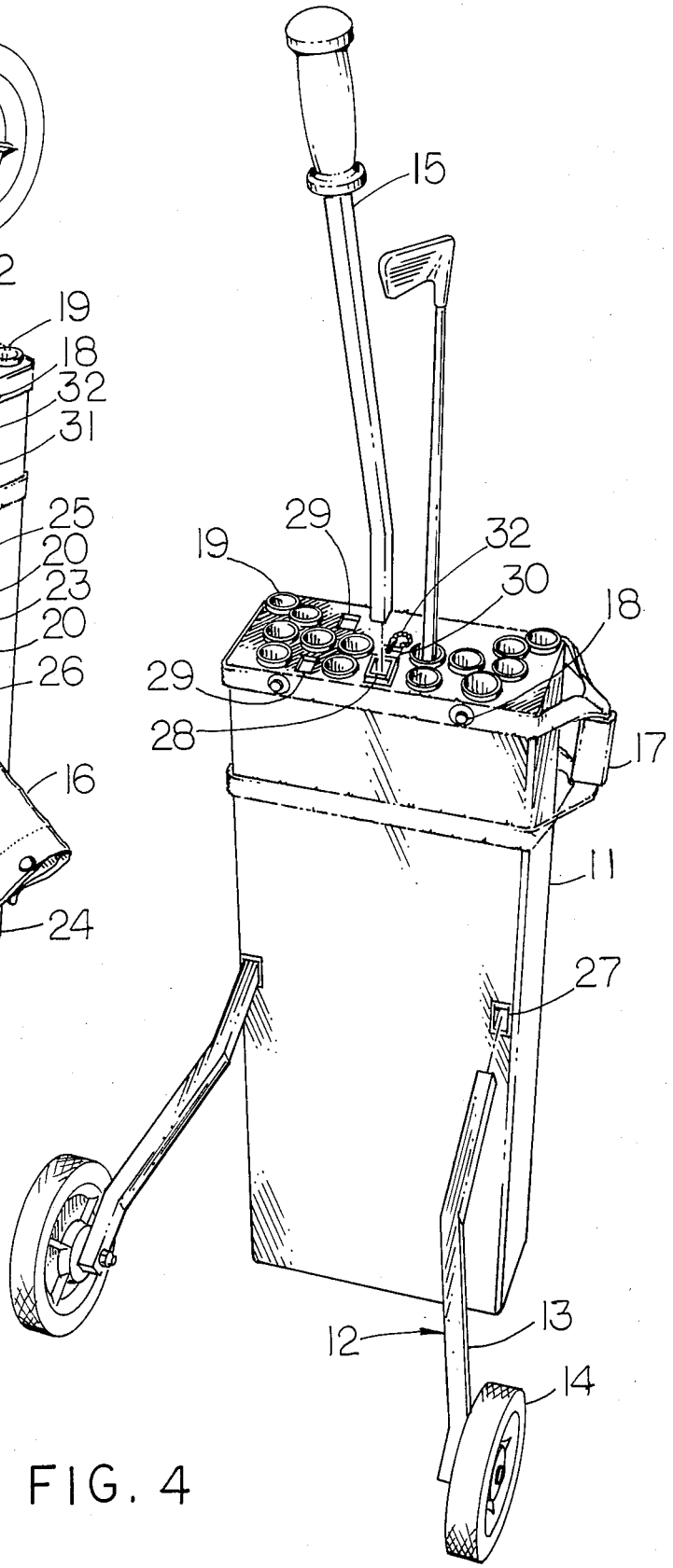
FIG. 4 is a view of the invention in an exploited fashion showing how the wheel struts and handle are placed into position for operation.

Referring now to FIG. 4, there is shown an exploded view of the invention. This view illustrates a few very important features of the invention which make it more simple to convert and operate (and viseversa), much easier to manufacture, more compact, and structurally more practical and sound for playing the game of golf than any other prior art. In FIG. 4 it can be seen that wheel-strut assembly 12, when operation of cart is desired, is inserted into appropriately manufactured wheel-strut receptacle 27 which is affixed to inside wall of cart body in such a way (reinforced and braced) that maximum stability is achieved. The precision of the receptacles are such that friction gently holds wheel-struts into place. A gentle push is all that is needed to insert, and a gentle pull is needed to remove struts. Similarly, the operating handle 15 is inserted into an operating handle receptacle 28. This receptacle is also precisioned so that insertion and removal of operating handle 15 is a gentle push or pull respectively. To secure handle when pulling cart in its operative mode a securing pin and chain 32 is provided. One end of the chain is fastened to the top of cart body 11 and the other has a pin (such as a cotter key) fastened to it. The pin is placed into a hole which affixes the operating handle 15 to the cart body 11 during operation. Also in FIG. 4 is seen receptacle holes 29 and 30. There are two holes 29 for the two wheel-strut assembly 12 and one for the operating handle 15. Use of receptacles 29 and 30 is seen in FIG. 3.

Figure 5:
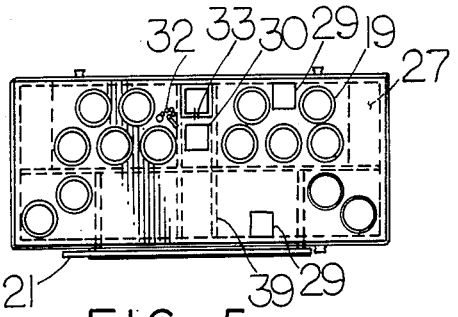
FIG. 5 is a top view of the invention showing arrangement of golf inserts, wheel-strut storage receptacles, operating handle receptacle, operating handle storage receptacle, securing pin and chain, hole for securing pin, arrangement of wheel-strut receptacles to club inserts and elevation of doors and panels on front surface.

Referring now to FIG. 5, a top view is seen showing arrangement of club inserts 19, operating handle receptacle 28 for handle operation, operating handle storage receptacle 30 for storage of handle, wheel-strut storage receptacles 29 for storage of wheel-strut assemblies, hole for handle securing pin 33, handle securing pin and chain 32, top view of bracing material 39, wheel strut receptacles 27, and top view showing relationship of raised compartment doors 21 and 22 and front panels 23 and 24.

Figure 6:
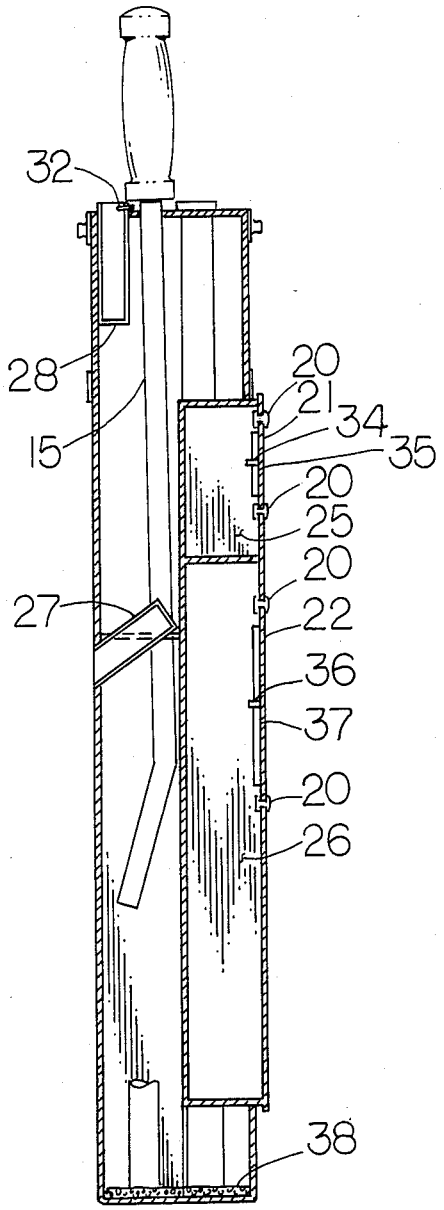
FIG. 6 is a side view of the invention showing wheel-strut receptacle position, operating handle receptacle, stored operating handle, storage compartments for balls, tees and clothing, door shims and stops, sliding apparatus for doors, and cushion for clubs.

Referring now to FIG. 6, a side view is seen with a portion cutaway to expose some internal features. The operating handle 15 is seen in its stored mode. The area that it occupies when stored is made when bracing material 39 (discussed in FIG. 5 and FIG. 7) is put into place. The bend at the end of the operating handle 15 is essential for balance when operating cart. The handle 15 is easily positioned in storage area because the operating handle receptacle 28 is short enough not to interfere when "bend" in handle is passed through its storage receptacle. A side view of the wheel-strut receptacle 27 is seen in its proper orientation. Compartments 25 and 26 are viewed from the side allowing for illustration of the compartment doors and panel parts. Ball and tee door shim 34 and clothing and accessory shim 36 are seen and will be discussed in FIG. 7. Ball and tee door stop 35 and clothing and accessory door stop 37 are viewed from the side and will be discussed further in FIG. 7 also. A cushion for clubs 38 is seen at the bottom of cart. The cushion is made of a closed cell foam rubber material so that water absorption is not a problem and also cuts down on noise production.

Figure 7:
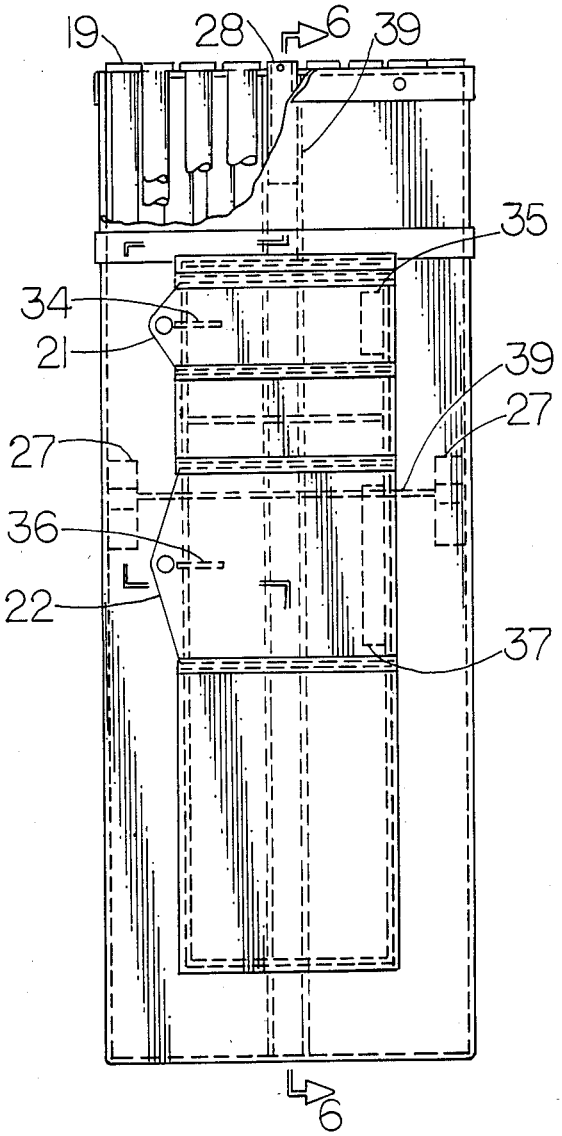
FIG. 7 is a front view of the invention showing doors and compartment areas, shims and stops for doors, bracing material positioning, cut-away showing club insert arrangement, and operating handle receptacle bracing.

Referring now to FIG. 7, which is a front view with partial cutaway showing inside tubes, etc. The golf club inserts 19 are seen in a simple arrangement. The operating handle receptacle 28 is seen with its bracing material 39 on both sides so that also braces entire cart body as shown. Bracing material 39 is also noted between wheel-strut receptacles 27. Bracing material 39 is fit into cart body so that it will contour to as many surfaces as possible to reinforce and strengthen entire cart body. Door shims 34 and 36 are shown. These shims are attached to back of doors and are wedge-shaped so that when door is shut it is at its tightest wedged position securing door into palce. The door stops 35 and 37 are flat pieces of similar material as body attached to the back of the door stoping it when opened and when closed so that door is always attached to cart. The "stop" occurs when the door stops 35 and 37 come up against the compartment walls.

The principle features of the invention having now been fully explained in connection with the foregoing description of the illustrations, the invention is hereby claimed as follows:

1. A combination golf cart and golf club bag for balance and stable pulling on a golf course, and for complete self containment for hand carrying away from or to a golf course, for car trunk transport, and for compact storage and shipment, and for quick conversion from a pulling assembly to a carrying and storage assembly, comprising:

(a) a rectangular golf equipment receiving body of a length to receive conventional golf club receiving tubes, to receive in turn a full fourteen golf club set, having:

two diagonal wheel strut end receiving non circular inserts, located substantially at the mid length of this body at each terminus of the sides of one of the largest width sides of this rectangular receiving body, which side, upon the pulling of this body over a golf course, is facing downwardly;

a top centered operating handle end receiving non circular straight insert, with a top entry inside the rectangular receiving body, adjacent the largest width side, which is facing downwardly during the pulling use of this receiving body over a golf course;

a full bottom of this receiving body having a top cushioned interior surface;

a full level top of this receiving body having: fourteen circular spaced recesses, adapted to receive conventional golf club receiving tubes, arranged in a U shaped pattern, with the base of the U being adjacent the largest width side, which is facing downwardly during the pulling use of this receiving body over a golf course; a non circular entry adapted to receive almost the entire length of an operating handle; and two non circular entries adapted to receive substantial portions of respective wheel struts;

fastening means arranged around this receiving body adjacent the full level top adapted to receive a flexible cover creating an additional enclosed volume above this full level top;

a handle means arranged about this receiving body, adjacent this fastening means, and adapted to be gripped at one of the smallest width sides of this rectangular receiving body;

a compartment means arranged within this receiving body below the handle means, and within the volume defined by the U shaped pattern of circular spaced recesses, which are adapted to receive and to position the conventional golf club receiving tubes, having a securable access through one of the largest width sides of this rectangle receiving body, which is facing upwardly, upon the pulling of this body over a golf course, whereby golf balls and tees are conveniently inserted and withdrawn;

another compartment means arranged within this receiving body below the compartment means adapted to receive golf balls and tees, and within the volume defined by the U shaped pattern of the circular spaced recesses, which are adapted to receive and to position the conventional golf club receiving tubes, having a securable access through one of the largest width sides of this receiving body, which is facing upwardly, upon the pulling of this body over a golf course, whereby a flexible cover is stored during a golfing outing remaining ready for subsequent use to create an additional enclosed volume above this full level top of this receiving body, and whereby other accessories needed by a golfer are selectably placed until needed;

(b) an operating handle of non circular cross section commencing in a top handle grip portion, extending straight therefrom for a major portion of the overall length of this operating handle, and then turning at an angle creating an end insertable portion adapted for frictional fitting within the top centered operating handle end receiving non circular straight insert of this receiving body, whereby, upon the pulling of the receiving body over a golf course the operating handle extends out ahead of this receiving body presenting this top handle grip portion at the hand level of the golfer, (c) a removable retaining means adapted to insure the retention of this operating handle within this receiving insert during the pulling of this receiving body over a golf course;

(d) a pair of wheel strut, axle, wheel, and securement means assemblies, each having: a wheel strut of non circular cross section, commencing in a straight top insertable end adapted for frictional fitting into one of the two diagonal wheel strut end receiving non circular inserts of the receiving body, then continuing in an outwardly bias downwardly extending portion to increase the tracking width to gain transverse stability, and terminating in a stright bottom end having receiving means to position an axle; an axle for positioning in this receiving means and extending radially outwardly from the wheel strut; a wheel for rotating about this axle; and a retaining means to keep the wheel, axle, and wheel strut in their operating positions; and (e) a flexible cover, for temporary storage in another compartment means during the pulling of the receiving body over the golf course, and for placement above this receiving body and securement about the full level top, using the adjacent fastening means, to provide an additional enclosed volume above this full level top, within which the heads of golf clubs will be positioned, the hand grip end of the operating handle will be positioned, and the wheels, axles, and the adjacent wheel-strut ends will be positioned, when this combination golf cart and bag is to be carried away from or to a golf course.

2. A combination golf cart and golf club bag for balanced and stable pulling on a golf course, and for complete self containment for hand carrying away from or to a golf course, for car trunk transport, and for compact storage and shipment, and for quick conversion from a pulling assembly to a carrying and storage assembly, comprising:

(a) a rectangular golf equipment bag of a length to receive golf club receiving tubes, to receive in turn a golf club set, having:

two diagonal wheel strut end receiving non circular inserts, located at the mid length of this bag at each terminus of the sides of one of the largest width sides of this rectangular bag, which side, upon the pulling of this bag over a golf course, is facing downwardly;

a top centered operating handle end receiving non circular straight insert, with a top entry inside the rectangular bag, adjacent the largest width side, which is facing downwardly during the pulling use of this bag over a golf course;

a full bottom of this bag;

a full level top of this bag having: circular shaped recesses adapted to receive golf club receiving tubes arranged in a U shaped pattern, with the base of the U being adjacent the largest width side, which is facing downwardly during the pulling use of this bag over a golf course; a non circular entry adapted to receive almost the entire length of an operating handle; and two non circular entries adapted to receive substantial portions of respective wheel struts;

fasteners arranged around this bag adjacent the full level top adapted to receive a flexible cover creating an additional enclosed volume above this full level top;

a handle arranged on the bag, adjacent these fasteners, and adapted to be gripped at one of the smallest width sides of this bag;

a compartment arranged within the bag below the handle and within the volume defined by the U shaped pattern of circular spaced recesses, which are adapted to receive and to position the golf club receiving tubes, having a securable access through one of the largest wide sides of this bag, which is facing upwardly, upon the pulling of this bag over a golf course, whereby golf balls, tees, and a flexible cover are stored during a golfing outing, with this flexible cover remaining ready for subsequent use to create an additional enclosed volume above this full level top of this bag into which other accessories needed by a golfer are selectively placed;

(b) an operating handle extending straight away from a hand gripping end for a major portion of the overall length of this operating handle, and then turning at an angle creating an end insertable within the top centered operating handle end receiving non circular straight insert of this bag, whereby, upon pulling the bag over a golf course, the operating handle extends out ahead of the bag, presenting the hand gripping end at the hand level of the golfer;

(c) a removable retaining pin adapted to insure the retention of this operating handle within this receiving insert during the pulling of this bag over a golf course;

(d) a pair of assemblies, each having: a wheel strut of non circular cross section, commencing in a straight top insertable end adapted for fitting into one of the two diagonal wheel strut end receiving non circular inserts of the bag, then continuing in an outwardly bias downwardly extending portion to increase the tracking width to gain transverse stability, and terminating in a straight bottom end having a receiving hole to position an axle; an axle for positioning in this receiving hole and extending radially outwardly from the wheel strut; a wheel for rotating about this axle; and a retaining means to keep the wheel, axle, and wheel strut in their operating positions; and (e) a flexible cover for temporary storage in the compartment during the pulling of the bag over the golf course, and for placement above the bag and securement about the full level top, using the adjacent fasteners to provide an additional enclosed volume above this full level top, within which the heads of golf clubs will be positioned, the handle in part will be positioned, and the wheels, axles, and adjacent wheel-strut ends will be positioned, when this combination golf cart and bag is to be carried away from or to a golf course.

3. A combination golf cart and golf club bag for balanced and stable pulling on a golf course, and for complete self containment for hand carrying away from or to a golf course, for car trunk transport, and for quick conversion from a pulling assembly to a carrying and storage assembly, comprising:

(a) a rectangular golf equipment bag to receive golf club receiving tubes which in turn are ready to receive golf clubs, having:

two wheel strut end receiving square interior inserts, located at the mid length of this bag on each side of a larger width side of this bag, which side is facing downwardly when the bag is being pulled on a golf course;

a top centered operating handle end receiving square interior insert, with a top entry inside the rectangular bag, adjacent the largest width side, which is facing downwardly when the bag is being pulled on a golf course;

a full bottom of this bag;

a full level top of this bag having: circular spaced recesses adapted to receive golf club receiving tubes arranged in a U shaped pattern, with the base of the U being adjacent the largest width side, which is facing downwardly when the bag is being pulled on a golf course; a square entry adapted to receive almost the entire length of an operating handle; and two square entries adapted to receive substantial portions of respective square tubing wheel struts;

fasteners arranged around this bag at the top to receive an unfolded foldable cover, which when unfolded creates an additional enclosed volume above the top of the bag;

a handle secured near the top of the bag;

a compartment arranged within the bag and within the volume defined by the U shaped pattern of circular spaced recesses, having securable access through one of the largest wide sides of this bag, which is facing upwardly when the bag is being pulled on a golf course, and golf balls, tees, and a folding cover are stored in this compartment during a golfing outing;

(b) a square tube operating handle having an end fitted into the top centered operating handle square interior insert of the bag, and then being turned at an angle presenting a hand gripping end at the hand level of a golfer;

(c) a removable fastener to insure the retention of the end of the operating handle within the square interior insert of the bag during the pulling of this bag over a golf course;

(d) a pair of wheel assemblies, each having: a square tube wheel strut commencing in a top adapted for fitting into one of the two square interior inserts of the bag, then continuing in an outwardly and rearwardly direction to increase the tracking width to gain transverse stability and to gain longitudinal balance, and terminating in a bottom having a receiving hold to position an axle; an axle for positioning in this receiving hole; a wheel for rotating about this axle; and a retainer to keep the wheel, axle, and wheel strut in their operating positions; and (e) a foldable cover for temporary folded storage in the compartment during a golf outing, and for unfolded placement and securement above the bag to provide an additional enclosed volume, into which the heads of golf clubs extend, along with portions of the control handle, the wheels, axles, and adjacent wheel-strut ends, when this combination golf cart and bag is to be carried to and from a golf course.

* * * * *